US011565293B2

(12) United States Patent
Bergmann et al.

(10) Patent No.: US 11,565,293 B2
(45) Date of Patent: Jan. 31, 2023

(54) REGULATING A ROLLING PROCESS

(71) Applicant: Primetals Technologies Austria GmbH, Linz (AT)

(72) Inventors: Martin Bergmann, Linz (AT); Konrad Krimpelstaetter, Gallneukirchen (AT)

(73) Assignee: Primetals Technologies Austria GmbH, Linz (AT)

( * ) Notice: Subject to any disclaimer, the term of this patent is extended or adjusted under 35 U.S.C. 154(b) by 0 days.

(21) Appl. No.: 16/963,176

(22) PCT Filed: Dec. 6, 2018

(86) PCT No.: PCT/EP2018/083787
§ 371 (c)(1),
(2) Date: Jul. 17, 2020

(87) PCT Pub. No.: WO2019/145079
PCT Pub. Date: Aug. 1, 2019

(65) Prior Publication Data

US 2021/0129199 A1 May 6, 2021

(30) Foreign Application Priority Data

Jan. 29, 2018 (EP) ..... 18153836

(51) Int. Cl.
*B21B 37/58* (2006.01)
*B21B 27/10* (2006.01)
*B21B 45/02* (2006.01)

(52) U.S. Cl.
CPC ..... *B21B 37/58* (2013.01); *B21B 27/10* (2013.01); *B21B 45/0251* (2013.01);
(Continued)

(58) Field of Classification Search
CPC ..... B21B 37/58; B21B 27/10; B21B 27/06; B21B 45/0251; B21B 45/02;
(Continued)

(56) References Cited

U.S. PATENT DOCUMENTS 8,584,499 B2 * 11/2013 Takahama ..... B21B 37/00 72/236
9,314,827 B2 * 4/2016 Atalla ..... B21B 27/06
(Continued)

FOREIGN PATENT DOCUMENTS

CN 101084074 A 12/2007
CN 102207439 A 10/2011
(Continued)

OTHER PUBLICATIONS

International Search Report and Written Opinion received in PCT/EP2018/083787 dated Jan. 22, 2019, pp. 17.
(Continued)

*Primary Examiner* — Shelley M Self
*Assistant Examiner* — Teresa A Guthrie
(74) *Attorney, Agent, or Firm* — Liang & Hennessey LLP; Brian Hennessey

(57) ABSTRACT

A method and a regulating device for regulating a rolling process, wherein a rolling material is rolled in a rolling gap between two working rollers of a rolling stand. A target forward slip value ($f_s$) for a forward slip (f) of the rolling material is specified, and an actual forward slip value ($f_M$) of the forward slip (f) of the rolling material is ascertained. The forward slip (f) of the rolling material is regulated to the target forward slip value ($f_s$) in that a lubricant rate ($u_R$) of a lubricant is applied to the rolling material and/or at least one working roller depending on the actual forward slip value ($f_M$) and the target forward slip value ($f_s$).

16 Claims, 2 Drawing Sheets

(52) U.S. Cl.
CPC ..... *B21B 2265/12* (2013.01); *B21B 2265/20* (2013.01); *B21B 2275/04* (2013.01)

(58) Field of Classification Search
CPC ..... B21B 45/0245; B21B 2265/12; B21B 2265/20; B21B 2275/04; B21B 2275/02; B21B 2275/06; B21B 45/0239; B21B 38/06
USPC ..... 72/236
See application file for complete search history.

(56) References Cited

U.S. PATENT DOCUMENTS

2005/0061047 A1* 3/2005 Laliberte ..... H01M 4/0404 72/147
2007/0068210 A1* 3/2007 Pittner ..... B21B 37/165 72/10.1
2012/0324971 A1* 12/2012 Simaan ..... B21B 37/50 72/7.4
2016/0318080 A1* 11/2016 Moretto ..... B21B 37/00

FOREIGN PATENT DOCUMENTS

| | | | |
|---|---|---|---|
| CN | 104801548 | A | 7/2015 |
| CN | 105916603 | A | 8/2016 |
| JP | 2005205432 | A | 8/2005 |
| KR | 20160101153 | A | 8/2016 |
| WO | 2005065854 | A1 | 7/2005 |

OTHER PUBLICATIONS

European Search Report received in 18153836.4 dated Jul. 3, 2018, pp. 7.
Chinese Office Action received in 201880088108.7 dated Jul. 2, 2021, pp. 29.

* cited by examiner

REGULATING A ROLLING PROCESS

CROSS-REFERENCE TO RELATED APPLICATIONS

The present application is a national phase application of PCT Application No. PCT/EP2018/083787, filed Dec. 6, 2018, entitled "REGULATING A ROLLING PROCESS", which claims the benefit of European Patent Application No. 18153836.4, filed Jan. 29, 2018, each of which is incorporated by reference in its entirety.

BACKGROUND OF THE INVENTION

1. Field of the Invention

The invention relates to a method for regulating a rolling process in which a rolling material is rolled in a rolling gap between two working rolls of a rolling stand.

2. Description of the Related Art

Owing to the deformation of the rolling material in the rolling gap, the rolling material upstream of the rolling gap and that downstream of the rolling gap have a lower and a higher speed, respectively, than the roll surfaces of the working rolls of the rolling stand. In the region of the rolling gap there is a "neutral point", at which the speeds of the rolling material and of the roll surfaces of the working rolls are the same. The neutral point is also referred to as the no-slip point. The position of the neutral point is important for the rolling process because the rolling process can easily become unstable, and the rolling material may slip in the rolling gap, if the neutral point is too close to the exit position at which the rolling material leaves the rolling stand but, on the other hand, friction losses due to the friction between the roll surfaces and the rolling material increase with increasing distance of the neutral point from the exit position.

DE 10 2005 059 653 A1 discloses a method for controlling a rolling process in which a metal strip is rolled flat. With the aid of a mathematical model, the magnitude of the planar yield stress of the metal strip and the magnitude of the hydrostatic pressure at the neutral point are estimated from measurable process parameters. The position of the neutral point is calculated based on the estimated magnitudes of a first group of the measurable process parameters and on the planar elasticity modulus and compressibility of the metal strip, and, if necessary, the rolling process is stabilized in accordance with the position of the neutral point by intervention with suitable measures.

EP 2 651 577 B1 discloses a method and a device for applying a lubricant during the rolling of metallic rolling material, in particular a rolled strip passed between two working rolls in a rolling gap. The teaching of EP 2 651 577 B1 envisages producing a mixture of lubricant and a carrier gas in an atomization device and applying it by means of spray nozzles to the surface of at least one working roll and/or to the surface of the rolled strip.

EP 2 893 986 A1 discloses a method and a device for applying a lubricating oil during the rolling of a flat metallic rolling material in a rolling stand. The lubricating oil is atomized in mixing chambers of spray nozzles by means of compressed air to form an aerosol and is sprayed onto the rolling material and/or at least one roll of the rolling stand by means of the spray nozzles.

WO 2007/025682 A1 discloses a method for lubricating and cooling rolls and metal strip during the rolling of metal strips, in which a minimum quantity of pure lubricant without a high water content and with a controlled viscosity is applied on the inlet side as a function of various process data, with continuous online metering, by means of a physical calculation model, and a coolant is applied by spraying on the outlet side.

EP 0 054 172 A2 discloses a method for rolling stress-free rolled strip by influencing the friction coefficient between the strip surfaces and the circumferential surfaces of the roll barrels as a function of partial tensile stresses determined in zones situated in the transverse direction of the strip downstream of the last stand, in which the circumferential surfaces of the roll barrel of the working rolls and/or the rolling gap are/is supplied with rolling emulsion. In this case, base oil of the emulsion is applied directly to the strip surface upstream of the entry of the strip into the rolling gap, in quantities determined by the partial tensile stresses ascertained and in locally limited areas.

US 2016/318080 A1 discloses a method for regulating at least one parameter of a rolling process, in which a metal product is rolled in a rolling stand that has at least two working rolls, wherein a forward slip is determined from the speed of the rolling product as it leaves the rolling stand and from the peripheral speed of the working rolls, and wherein an approximate value for the coefficient of friction is estimated as a function of the measured rolling force of the working rolls and the forward slip ascertained, and this estimated value is used to regulate the at least one parameter of the rolling process.

SUMMARY OF THE INVENTION

The object of the invention is to specify a method and a device for regulating a rolling process which are improved especially in respect of the position of the neutral point.

The method according to the invention is used to regulate a rolling process in which a rolling material is rolled in a rolling gap between two working rolls of a rolling stand. In this case, a target forward slip value (also referred to as a desired forward slip value) for a forward slip of the rolling material is specified, and an actual forward slip value of the forward slip of the rolling material is determined. The forward slip of the rolling material is regulated to the target forward slip value in that a lubricant rate of a lubricant is applied to the rolling material and/or to at least one working roll based on the actual forward slip value and the target forward slip value.

The forward slip of the rolling material is defined as follows:

$$f = \frac{v_1 - v_N}{v_N}, \qquad [1]$$

wherein f denotes the forward slip, $v_1$ denotes the exit speed of the rolling material downstream of the rolling stand and $v_N$ denotes the roll speed of a roll surface of a working roll with which the rolling material is rolled. In this context, the terms "upstream" and "downstream" of the rolling stand or rolling gap relate to the rolling direction in which the rolling material is passed through the rolling gap.

A lubricant rate is interpreted to mean a lubricant quantity per unit time.

The invention makes use of the fact that the forward slip defined by equation [1] is a measure of the position of the neutral point. The closer the neutral point is to the exit position of the rolling material, the smaller is the forward slip. Negative values of the forward slip indicate that the rolling material is slipping in the rolling gap. By means of the regulation according to the invention of the forward slip, it is therefore possible to optimize the position of the neutral point, and it is possible for slipping of the rolling material to be detected or for slipping to be counteracted. The use of the forward slip as the controlled variable furthermore has the advantage that the forward slip can be determined in a simple and reliable way since the exit speed of the rolling material and the roll speed of a working roll can be measured simply and directly.

A refinement of the invention accordingly envisages that the exit speed of the rolling material is measured downstream of the rolling stand, a roll speed of a roll surface of a working roll is determined, and the actual forward slip value is determined from the exit speed and the roll speed in accordance with equation [1].

The invention furthermore makes use of the fact that the forward slip or the position of the neutral point can be changed by varying a lubricant rate dispensed onto the rolling material and/or onto at least one working roll. The lubricant influences the friction between the working rolls and the rolling material. The change in the lubricant rate therefore changes the friction between the working rolls and the rolling material and thereby also causes a shift in the neutral point.

Regulating the forward slip by changing the lubricant rate also allows optimized use of the lubricant during the rolling process since the lubricant rate is not set in a fixedly specified way or on the basis of a mathematical rolling model of the rolling process, which is subject to uncertainties, but in accordance with the actual forward slip value, which can be determined by direct measurements, in order to regulate the forward slip to the desired forward slip value.

Moreover, the invention has the advantage that a mathematical rolling model of the rolling process that may additionally be used, which simultaneously allows for a multiplicity of process parameters (e.g. a rolling force distribution in the individual rolling stands of a roll train, strip tensions and/or pass reductions in the rolling stands) in order to produce the desired rolling product, is not affected by the regulation according to the invention, which acts only on the lubricant system.

The method according to the invention is therefore also particularly well-suited as a retrofit solution for existing roll trains in order to increase product quality without having to change anything in the existing rolling model. Thus, for example, it is known that, particularly in the case of working rolls that have been in use for a long time, there is an increased incidence of unwanted slippage of the rolling material in the rolling gap owing to the wear of the surface texture of the working rolls, and this is generally not modelled in a traditional rolling model. As has already been mentioned above, the slippage can be detected reliably and in good time in the case of the method according to the invention, and slippage can be counteracted by an appropriate change in the lubricant rate.

One refinement of the invention envisages that approximately 0.05 is specified as the desired forward slip value. A desired forward slip value of approximately 0.05 has proven advantageous since, at this value of the forward slip, the neutral point is on the one hand close to the exit position of the rolling material downstream of the rolling gap, thus minimizing the frictional losses in the rolling gap, but, on the other hand, there is still a sufficient safety clearance between the neutral point and the exit position to avoid slippage of the rolling material in the rolling gap.

Another refinement of the invention envisages that a hysteresis interval is specified for the forward slip, and the lubricant rate is changed only if the actual forward slip value deviates from the hysteresis interval. For example, an upper limit of the hysteresis interval is approximately 0.03 higher than the desired forward slip value and/or a lower limit of the hysteresis interval coincides with the desired forward slip value. This ensures that an intervention in the supply of lubricant takes place only when the actual forward slip value deviates from the hysteresis interval, ensuring that regulation does not become too unsteady. A lower limit of the hysteresis interval coinciding with the desired forward slip value is advantageous especially if the desired forward slip value corresponds to a position of the neutral point close to the exit position of the rolling material downstream of the rolling gap since, in this case, undershooting of the desired forward slip value can rapidly lead to slippage of the rolling material in the rolling gap. In contrast, exceeding of the desired forward slip value by approximately 0.03 can generally be tolerated since the frictional losses in the rolling gap do not rise excessively as a result.

Further refinements of the invention envisage that a friction coefficient of a friction between the rolling material and a working roll is determined, and the lubricant rate is also applied in accordance with the friction coefficient, and/or in that a rolling force acting on the rolling material in the rolling gap is determined, and the lubricant rate is also applied in accordance with the rolling force. These refinements take account of the fact that the action of the rolling stand also depends on the friction coefficient of the friction between the rolling material and a working roll and on the rolling force acting on the rolling material, and regulation can therefore be improved by allowing for these variables.

A further refinement of the invention envisages that, for the application of the lubricant rate, a mixture of lubricant and a carrier gas is produced and sprayed onto at least one working roll and/or into the rolling gap. This application of lubricant, which is also referred to as minimum quantity lubrication, is advantageous since the direct application of pure lubricant into the rolling gap or onto the working rolls allows short response times for the regulation of the forward slip.

As an alternative or in addition, it is possible, for the application of the lubricant rate, for a rolling emulsion containing lubricant to be produced and applied to the rolling material and/or to at least one working roll, and/or for pure lubricant to be applied to the rolling material upstream of the rolling gap and at a distance from the rolling gap. By means of the application of a rolling emulsion containing lubricant, the rolling material and the working rolls can be additionally cooled. The application of pure lubricant to the rolling material upstream of the rolling gap and at a distance from the rolling gap is also referred to as direct application and allows a targeted improvement of the lubricating effect of the lubricant but, owing to the distance at which the lubricant is applied to the rolling material upstream of the rolling gap, has a longer response time for the regulation of the forward slip than minimum quantity lubrication.

A regulating device according to the invention for carrying out the method according to the invention comprises a forward slip determination device, which is set up to determine the actual forward slip value of the forward slip of the rolling material, a lubricant dispensing device, which is set up to dispense the lubricant onto the rolling material and/or onto at least one working roll, a regulating unit, which is set up to regulate the forward slip of the rolling material to the desired forward slip value by setting a lubricant rate of the lubricant dispensed by the lubricant dispensing device in accordance with the actual forward slip value and the desired forward slip value.

In this case, the forward slip determination device is preferably set up to measure an exit speed of the rolling material downstream of the rolling stand and to determine a roll speed of a roll surface of a working roll.

The lubricant dispensing device is set up, for example, to produce a mixture of lubricant and a carrier gas and to spray the mixture onto at least one working roll and/or into the rolling gap, and/or to produce a rolling emulsion containing lubricant and to dispense the rolling emulsion onto the rolling material and/or onto at least one working roll, and/or to dispense pure lubricant onto the rolling material at a distance upstream of the rolling gap.

A regulating device according to the invention makes it possible to carry out the method according to the invention. The advantages of a regulating device of this kind therefore correspond to the abovementioned advantages of the method according to the invention.

BRIEF DESCRIPTION OF THE DRAWINGS

The above-described properties, features and advantages of this invention and the manner in which these are achieved will become more clearly and distinctly comprehensible in conjunction with the following description of illustrative embodiments, which are explained in greater detail in conjunction with the drawings. In this case.

DETAILED DESCRIPTION

Figure 1:
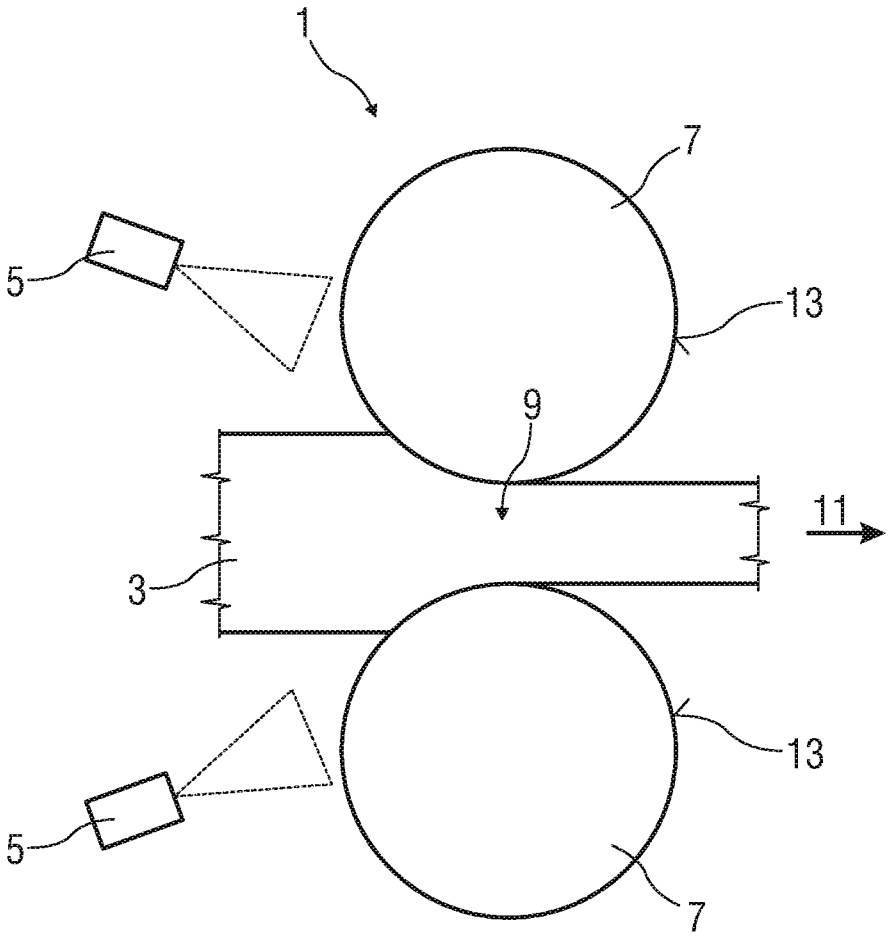
FIG. 1 shows schematically a rolling stand, a rolling material and a lubricant dispensing device.

FIG. 1 shows schematically a rolling stand 1 by means of which a rolling material 3 is rolled, and a lubricant dispensing device 5 for dispensing a lubricant.

The rolling stand 1 has two working rolls 7, which are spaced apart by a rolling gap 9. The rolling material 3 is in the form of a metallic rolled strip, which is passed through the rolling gap 9 in a rolling direction 11. During the rolling of the rolling material 3, the two working rolls 7 rotate at angular speeds of the same magnitude but mutually opposite directions, with the result that their roll surfaces 13 have a roll speed $v_N$, the direction of which corresponds to the rolling direction 11 at the location of the rolling gap 9.

By means of the lubricant dispensing device 5, it is possible, for example, to produce a mixture of lubricant and a carrier gas and to spray it onto the working rolls 7 and/or into the rolling gap 9. For this purpose, the lubricant dispensing device 5 has, for example, an atomization device, in which the mixture can be produced, and a plurality of spray nozzles, by means of which the mixture can be dispensed.

As an alternative or in addition, the lubricant dispensing device 5 can be used, for example, to produce a rolling emulsion containing lubricant and to dispense it onto the rolling material 3 and/or onto the working rolls 7.

Moreover, the lubricant dispensing device 5 can alternatively or additionally be used to dispense pure lubricant onto the rolling material 3 upstream of the rolling gap 9 and at a distance from the rolling gap 9, for example.

By means of the lubricant dispensed using the lubricant dispensing device 5, the rolling process is regulated in the manner described in greater detail below with reference to FIG. 3.

Figure 2:
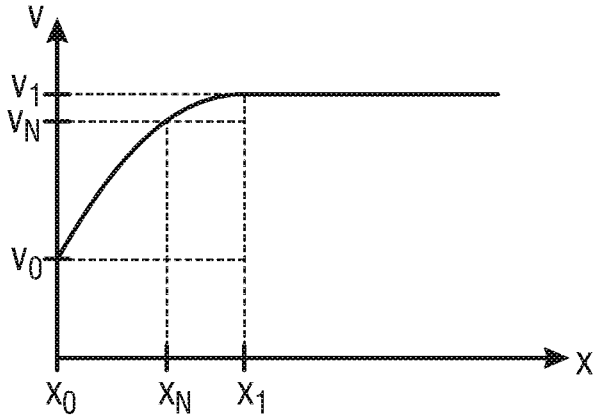
FIG. 2 shows a diagram of a rolling material speed as a function of a rolling material position.

FIG. 2 shows a diagram of a rolling material speed v of the rolling material 3 as a function of a rolling material position x in the region of the rolling gap 9. At an entry position $x_0$ upstream of the rolling gap 9, the rolling material 3 has an entry speed $v_0$. In the rolling direction 11, the rolling material speed v increases in the region of the rolling gap 9 until it reaches an exit speed $v_1$ at an exit position $x_1$ downstream of the rolling gap 9. Between the entry position $x_0$ and the exit position $x_1$, the rolling material speed v adopts the value of the roll speed $v_N$ of the roll surfaces 13 of the working rolls 7 at a no-slip position $x_N$ defining the neutral point.

Figure 3:
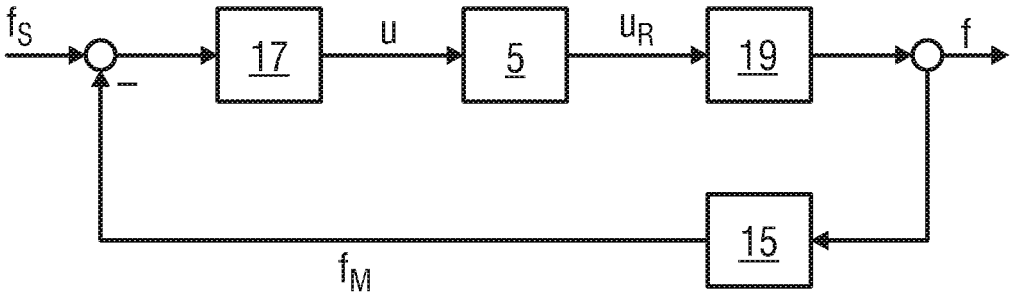
FIG. 3 shows a block diagram of a control loop for regulating a rolling process.

FIG. 3 shows a block diagram of a control loop for regulating the rolling process in which the rolling material 3 is rolled in the rolling gap 9 between the working rolls 7 of the rolling stand 1. The rolling process is regulated by means of a regulating device which comprises a forward slip determination device 15, the lubricant dispensing device 5 and a regulating unit 17. The regulating unit 17 is the controller of the control loop, the lubricant dispensing device 5 is the actuator of the control loop, the forward slip determination device 15 is the measuring element of the control loop, and the rolling stand 1 and the rolling material 3 form the control path 19 of the control loop.

The control variable of the control loop is the forward slip f of the rolling material 3, which, according to equation [1], is formed from the exit speed $v_1$ and the roll speed $v_N$. FIG. 2 shows that the forward slip f is a measure of the position of the neutral point. The closer the neutral point is to the exit position $x_1$, the smaller is the forward slip f. The forward slip f is therefore particularly suitable as a control variable for regulating the position of the neutral point.

To regulate the rolling process, a desired forward slip value $f_s$, to which the forward slip f is regulated, is specified. Approximately 0.05 is specified as the desired forward slip value $f_s$, for example.

The forward slip determination device 15 is used to determine an actual forward slip value $f_M$ of the forward slip f. For this purpose, the forward slip determination device 15 is set up to measure the exit speed $v_1$ of the rolling material 3 downstream of the rolling gap 9 and to determine the roll speed $v_N$. The exit speed $v_1$ is measured, for example, by means of at least one strip tension measuring roller, which is arranged downstream of the rolling stand 1 and rolls on a rolling material surface of the rolling material 3. As an alternative, the exit speed $v_1$ is measured optically, e.g. by means of laser measurement. The roll speed $v_N$ of a working roll 7 is determined from the angular speed and radius of the working roll 7, for example, wherein the angular speed is determined from a rotational speed of a motor driving the working roll 7, for example.

From the desired forward slip value $f_s$ and the actual forward slip value $f_M$, a control deviation is formed by subtracting the actual forward slip value $f_M$ from the desired forward slip value $f_s$. The regulating unit 17 forms a control variable u dependent on the control deviation, and said variable is applied to the lubricant dispensing device 5. The lubricant dispensing device 5 outputs, as a manipulated variable of the control loop, a lubricant rate $u_R$ of the lubricant, which is dependent on the control variable u, wherein the lubricant rate $u_R$ denotes a lubricant quantity per unit time. For example, a hysteresis interval is specified for the forward slip f, and the lubricant rate $u_R$ is changed only if the actual forward slip value $f_M$ deviates from the hysteresis interval. For example, a hysteresis interval is specified, the upper limit of which is approximately 0.03 greater than the desired forward slip value $f_s$ and the lower limit of which coincides with the actual forward slip value $f_M$.

In a further development of the method, described with reference to FIG. 3, for regulating the rolling process, the lubricant rate $u_R$ is additionally set in accordance with at least one further parameter of the rolling process. For example, a friction coefficient of a friction between the rolling material 3 and a working roll 7 is determined as a further parameter, and the lubricant rate $u_R$ is also set in accordance with the friction coefficient. As an alternative or in addition, a rolling force acting on the rolling material 3 in the rolling gap 9 is determined as a further parameter, for example, and the lubricant rate $u_R$ is also set in accordance with the rolling force. In this case, the friction coefficient and/or the rolling force are determined in real time from current process variables of the rolling process by means of a rolling gap model, for example.

Although the invention has been illustrated and described more specifically in detail by means of preferred illustrative embodiments, the invention is not restricted by the examples disclosed, and other variations can be derived therefrom by a person skilled in the art without exceeding the scope of protection of the invention.

LIST OF REFERENCE SIGNS

1 rolling stand
3 rolling material
5 lubricant dispensing device
7 working roll
9 rolling gap
11 rolling direction
13 roll surface
15 forward slip determination device
17 regulating unit
19 control path
f forward slip
$f_M$ actual forward slip value
$f_s$ desired forward slip value
v rolling material speed
$v_0$ entry speed
$v_1$ exit speed
$v_N$ roll speed
u control variable
$u_R$ lubricant rate
x rolling material position
$x_0$ entry position
$x_1$ exit position
$x_N$ no-slip position

The invention claimed is:

1. A method for regulating a rolling process in which a rolling material is rolled in a rolling gap between two working rolls of a rolling stand, comprising:

specifying a target forward slip value for a forward slip of the rolling material;

determining an actual forward slip value of the forward slip of the rolling material;

forming, in a control path, a control variable based directly on the actual forward slip value and the target forward slip value; and applying a lubricant at a lubricant rate to at least one of the rolling material and at least one working roll based on the control variable to regulate the forward slip of the rolling material to the target forward slip value.

2. The method as claimed in claim 1, further comprising:

measuring an exit speed of the rolling material downstream of the rolling stand, determining a roll speed of a roll surface of a working roll, and determining the actual forward slip value from the exit speed and the roll speed.

3. The method as claimed in claim 1, wherein 0.05 is specified as the target forward slip value.

4. The method as claimed in claim 1, wherein a hysteresis interval is specified for the forward slip, and the lubricant rate is changed only if the actual forward slip value deviates from the hysteresis interval.

5. The method as claimed in claim 4, wherein an upper limit of the hysteresis interval is 0.03 higher than the target forward slip value.

6. The method as claimed in claim 4, wherein a lower limit of the hysteresis interval coincides with the target forward slip value.

7. The method as claimed in claim 1, further comprising:

determining a friction coefficient of a friction between the rolling material and a working roll, and applying the lubricant based also on the friction coefficient.

8. The method as claimed in claim 1, further comprising:

determining a rolling force acting on the rolling material in the rolling gap, and applying the lubricant based also on the rolling force.

9. The method as claimed in claim 1, wherein, for the application of the lubricant, a mixture of the lubricant and a carrier gas is produced and sprayed at least one of onto at least one working roll and into the rolling gap.

10. The method as claimed in claim 1, wherein, for the application of the lubricant, a rolling emulsion containing the lubricant is produced and applied to at least one of the rolling material and at least one working roll.

11. The method as claimed in claim 1, wherein, for the application of the lubricant, the lubricant is applied in pure form to the rolling material upstream of the rolling gap and at a distance from the rolling gap.

12. A regulating device for carrying out the method as claimed in claim 1, comprising:

a forward slip determination device determining the actual forward slip value of the forward slip of the rolling material;

a lubricant dispensing device, which is set up to dispense the lubricant at least one of onto the rolling material and onto at least one working roll; and a regulating unit, which is set up to regulate the forward slip of the rolling material to the target forward slip value by setting the lubricant rate of the lubricant dispensed by the lubricant dispensing device in accordance with the actual forward slip value and the target forward slip value.

13. The regulating device as claimed in claim 12, wherein the forward slip determination device is set up to measure an exit speed of the rolling material downstream of the rolling stand and to determine a roll speed of a roll surface of a working roll.

14. The regulating device as claimed in claim 12, wherein the lubricant dispensing device is set up to produce at least one of:

a mixture of lubricant and a carrier gas and to spray the mixture at least one of:

onto at least one working roll; and into the rolling gap; and a pure lubricant dispensed onto the rolling material at a distance upstream of the rolling gap.

15. The method as claimed in claim 1, wherein the forming of the control variable is performed without accessing a model.

16. The method as claimed in claim 2, wherein the exit speed of the rolling material is measured by a strip tension measuring roller.

* * * * *